US005893306A

United States Patent [19]

Owoc

[11] Patent Number: 5,893,306

[45] Date of Patent: Apr. 13, 1999

[54] RATCHET WRENCH GEARS COMPRISING FLOATING-CAM-DRIVEN ADJUSTABLE JAWS

[76] Inventor: Gregory John Owoc, 735 Wade Hampton Blvd. Lot A-9, Greenville, S.C. 29609

[21] Appl. No.: 08/912,212

[22] Filed: Aug. 15, 1997

[51] Int. Cl.[6] ..... B25B 13/46

[52] U.S. Cl. ..... 81/60; 81/163

[58] Field of Search ..... 81/128, 129, 163, 81/165, 170, 113–116, 60–63.2; 279/47–50, 60–66, 69–70

[56] References Cited

U.S. PATENT DOCUMENTS 5,207,129 5/1993 Fossella ..... 81/128 X

*Primary Examiner*—D. S. Meislin
*Attorney, Agent, or Firm*—Hardaway Law Firm, P.A

[57] ABSTRACT

Ratchet wrench gears, for use in standard and pneumatic ratchet wrenches include adjustable jaws that may grip a fastener on at least four sides. The jaws travel on tracks or rails and open and close by means of threaded, floating-cams, which urge upon a protruding cam portion integral to the jaw body. The cams are driven axially by turning a threaded-stem-disc, which may comprise a hollow center, thus allowing for a "through-hole" feature. Various, optional compression-spring means are included to continually bias jaws toward an open position.

17 Claims, 3 Drawing Sheets

FIG. 4
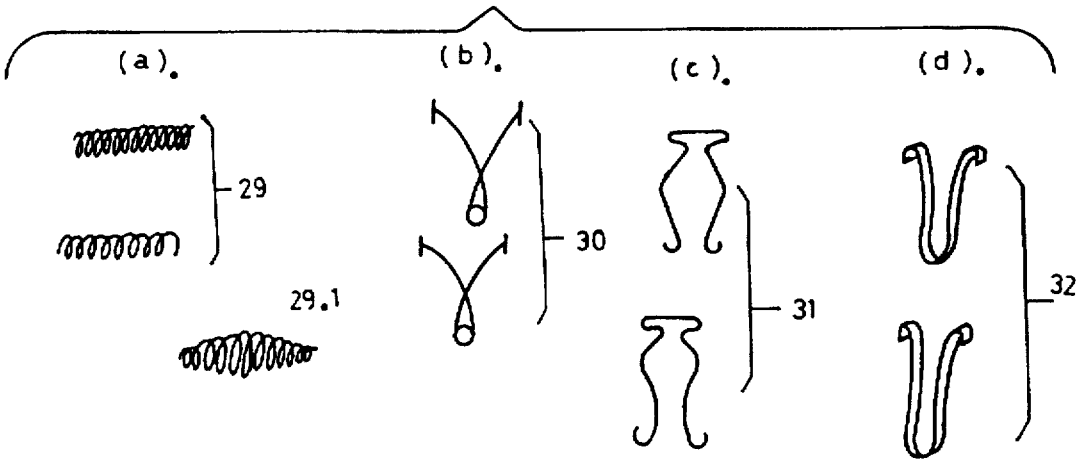
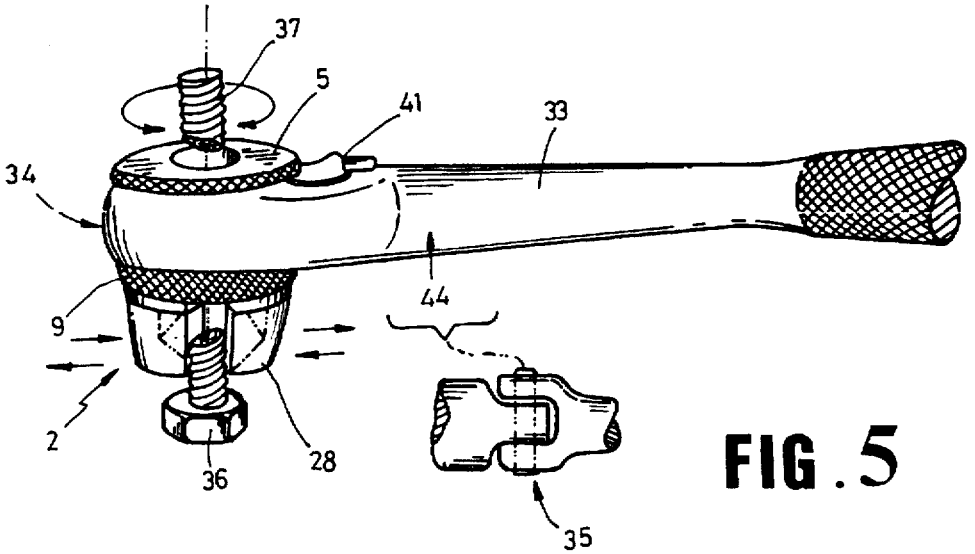
FIG. 5
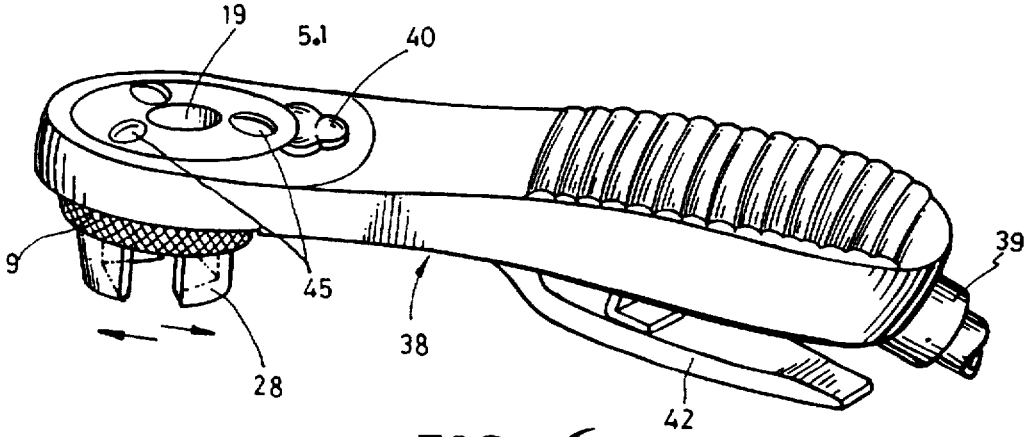
FIG. 6

RATCHET WRENCH GEARS COMPRISING FLOATING-CAM-DRIVEN ADJUSTABLE JAWS

BACKGROUND (1) Field of Invention

The present invention discloses ratchet gears, used in standard and pneumatic ratchet wrenches, which comprise adjustable jaws that are used to grip a fastener on at least four sides. The jaws, preferably traveling on rails or tracks, move inward and outward on a plane that is 90 degrees to the longitudinal axis of the gear body, through this sliding plane may be more or less than 90 degrees. A typical drive-means used in the prior art to drive adjustable socket jaws are horizontal thread-means used in the prior art to drive adjustable socket jaws are horizontal thread-means used in the prior art to drive adjustable socket jaws are horizontal thread-means, such as a double-threaded-stemmed knurled wheel, as in U.S. Pat. No. 4,864,901 and a single-threaded-stemmed wheel, as U.S. Pat. No. 4,798,108.

However, in the present invention, unique, angular cam surfaces integral to the jaws, contact novel, threaded, floating-cams which urge upon the jaws' cam surfaces. As a threaded rod or threaded-stem-disc is turned, the floating cams are driven in the direction of the gear's A longitudinal axis, not horizontally. Since the thread outside diameter may be wide enough to have a bore, a through-hole may be used in this structure and this feature minimized the need for "deep-well" type sockets. This unique structure prevents the gear from having to be too large, while allowing for fairly good jaw opening tang. One unfortunate drawback of the present invention is that it cannot be used as an independent socket, since the threaded-stem-disc, with or without through-hole, is necessarily located exactly where the socket range would need to be inserted.

(2) Description of Prior Art

Adjustable socket means have been known in prior art for several decades. One useful socket is found in U.S. Pat. No. 4,608,887 wherein a socket support body, comprising parallel slots in which parallel, cammed gripping surfaces slide while supported in an annular, rotatable flange. The drive means employed for driving the flange axially is a nut upon a threaded stem, located on the socket body. While effective, this socket requires a relatively wide girth and lengthy profile to operate.

In U.S. Pat. No. 4,385,534, externally fixed cam surfaces are used in conjunction with an adjusting screw means to bias inner, flexible jaws inward and outward upon a fastener. This socket comprises limitations not only due to the fact that the hard steel necessary for socket manufacture is not compatible with flexible steel, but the fact that the jaws are biased at an angle results in nonflush contact upon the sides of a fastener at sizes smaller than the maximum gripping aperture.

Less recent is an adjustable socket means that comprises two jaws pivoting upon a balljoint toward a fastener's sides, disclosed in U.S. Pat. No. 3,898,897. An impediment in this structure, as similar to the previous patent is the fact that since the jaws pivot from a central point, nonflush contact is also made on the sides of the fastener as the socket is adjusted.

Socket means that use linkage arms in conjunction with threaded adjusting means are found in U.S. Pat. Nos. 4,911,040 and 4,366,732. Though these structures allow for larger than average jaw-opening capacity, they require complex and bulky mechanical structures.

From the above discussed prior art it is evident that efforts have been made to produce an adjustable socket means which will securely grip a range of fasteners and include sufficient jaw-opening capacity so as to be of maximum usefulness. As well, efforts have been made to make such a socket means of relatively narrow girth and low-height profile and of few and reliable, strong parts having jaws that would open and close rapidly and tightly upon a fastener. It is an object of the present invention to meet the above requirements in an adjustable socket gear-means which may be used in standard and pneumatic ratchet wrenches presently in use.

It is another object to provide these ratchet gears with an optional hollow core or center along the gear's longitudinal axis, in order to provide the wrench user with a more useful wrench that may pass, for example, a threaded stem through itself.

Another object of this invention is to provide a threaded-stem-disc that is conveniently located on the top area of the ratchet wrench head and thus may be easily turned to adjust to the proper fastener size.

BRIEF SUMMARY OF THE INVENTION

The present adjustable-jaw ratchet gears may be summarized as follows:

A ratchet gear comprising rails or tracks upon which two jaws, having 120 degree-angled faces opposing one another, may close and open upon a hexagonal faster. The jaws comprise mating rail portions integral, above and parallel to the jaw-faces, positioned, winglike, one on each side. These rail portions, which may be T-Slotted or "dove-tail" as depicted in the drawings, or many other optional shapes, slidingly support the jaws and also torsionally stabilize the jaws in a fixed position as the wrench is torqued upon a fastener.

The jaws also comprise, preferably nested in between the rail portions, on their uppermost portion, integral, angular cam surfaces. These cam surfaces protrude generally upward and angularly inward with respect to the gear body internal axis. A set, preferably two, floating-cams are nested in a rectangular cavity preferably opposite one another, centrally internal to the gear body. These cams comprise a threaded portion on their inside surfaces whereby the cams simultaneously engage, preferably opposite one another, the threaded stem of a threaded-stem-disc. The threaded-stem-disc is located conveniently near the top of the wrench-head and as it is turned, the floating cams travel upward and downward, parallel to the gear's longitudinal axis, while nested in the said gear's rectangular cavity. Since the cams have on their ends opposite the threads, cam portions that simultaneously mate with and positionally urge inward the said jaw cam surfaces use the floating cams move downward, driving movement is applied to the jaws. Many cam-mating configurations could serve to adequately provide the driving forces necessary to urge the jaws to close, but the preferable means is having the curved cam follower on the said jaws and the generally angular and flat driving surface on the said floating cams, although this arrangement may be easily reversed. As well, both contacting cam surfaces may be flat-mating or curve-mating.

A compression spring means continually biases the jaws into an open position so that the jaws will always have mutual cam-contact pressure being applied upon the respective opposing cam surfaces in whatever position the floating cams may be. Thus, turning the said threaded-stemmed-disc to raise the floating cams simply relieves spring pressure as the jaws open, and consequently increases spring pressure as the jaws tighten.

By providing a fairly larger diameter said threaded-stem-disc, a central through-bore may be included in the same and thus allow for a through-hole center inside the gear apparatus. This feature would enable the wrench to accommodate a threaded rod that extends from, for example, a nut, an application where deep-well sockets are typically used. An elliptical indenture may be included along the inside length of the said jaws' cam protrusions so that clearance would be provided for threaded rods of various sizes, as the said jaws closed upon the correspondingly smaller fasteners.

Various types of biasing means may be used to urge said jaws into a continually open position. As well, the said threaded-stem-disc, serving as an "adjusting wheel or knob" may be simply a screw means without the wheel or disc portion, even non-hollow. Many different versions of guides or rails may be also employed to slidably, torsionally retain said jaws. The floating cams may be comprised of various shapes of diverse thread styles and sizes, all still axially slidable and driven by a threaded-stem-means, itself of several possible variations.

The adjustable jawed gear may be used in standard and pneumatically operated ratchet wrenches presently in use and it should be obvious to one skilled in the art to see possible general modifications that may be substituted for those employed to achieve the purposes of the present invention, while not departing from the spirit or scope of the present invention.

BRIEF DESCRIPTION OF THE DRAWINGS

FIG. 4 is an angular perspective view of four different, optional spring means to continually bias the jaws into an open position.

FIG. 5 is an angular perspective of the adjustable-jawed gear as fully operational in a standard, "tear-drop" type ratchet wrench in present use.

FIG. 6 is an angular perspective of the adjustable-jawed gear as fully operational in a standard, pneumatic ratchet wrench in present use.

DETAILED DESCRIPTION OF THE PREFERRED EMBODIMENTS

Figure 1:
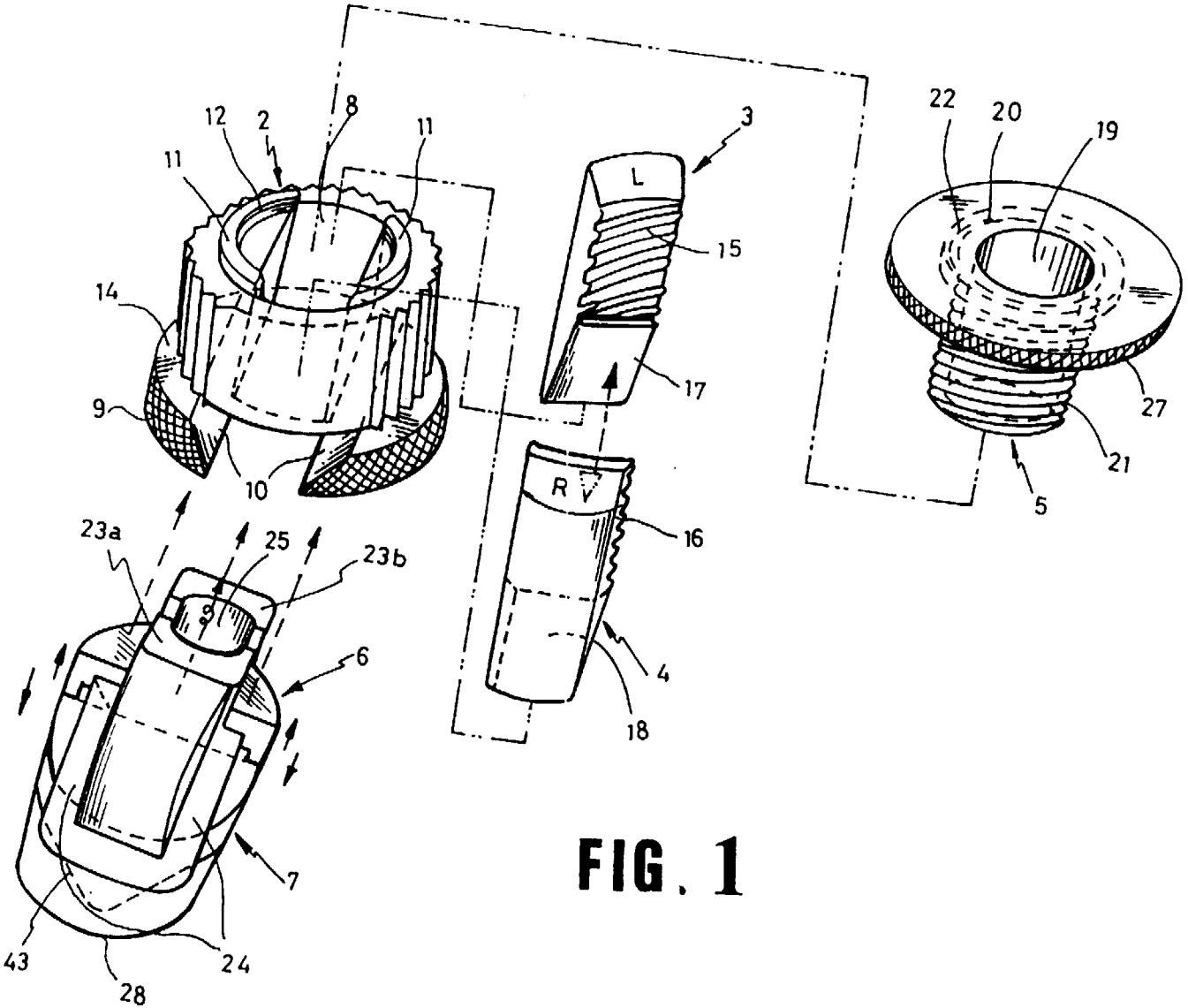
FIG. 1 depicts an exploded top, angular perspective of the adjustable-jawed gear means' six major components assembly view.
Figure 3:
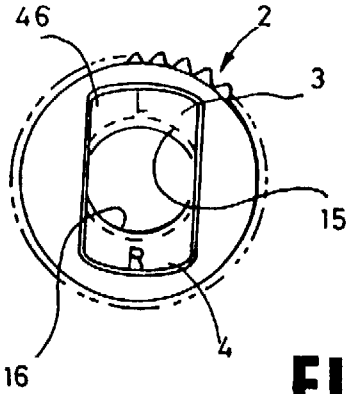
FIG. 3 is a flat, top-perspective view of the left and right floating cams as they would appear as one, unitized cam means, nested in the gear's rectangular cavity.

In describing the preferred embodiments of the invention illustrated in the drawings and summarized above, specific terminology will be resorted to for sake clarity.

However, it is not intended to be limited to the terms so selected and it is to be understood that each specific term includes all technical equivalents which operate in a similar manner to accomplish a similar purpose.

With reference to the invention of the adjustable-jawed-gear means 2, also hereinafter referred to as AJG 2, please note FIGS. 1, 2, 2*a*, 2*b*, 3 and FIGS. 5 and 6, wherein the said AJG 2 comprises a left and right floating cams, 3 and 4 (note also FIG. 3's alternate, unitized cam means 46), which slidably fit, opposite one another in rectangular gear cavity 8. Said floating cams 3,4 and their respective threaded portions, 15, 16 are driven longitudinally by threaded-stemmed-disc 5, also hereinafter referred to as TSD 5, which comprises outer threads 21 and knurled-disc 27. Said TSD 5 is rotatably fixed and axially stationarily fixed in the center of said rectangular gear cavity 8, as inner-shoulder's 20 outer-groove 22 mates with said AJG's outer-shoulders 11 inner-groove 12 by means of a snap-ring (not shown).

Left and right jaws 6, 7 respectively, are depicted as identical with jaw ends 28 and inside 120 degree fastener gripping faces 43, and face opposing one another supported upon said AJG's 2 knurled-annular flange's 14 dovetail rails 10. Said rails 10 slidably receive inner mating, jaw rail portions 24 and provide both torsional and "jaw-spreading" load sustaining structure for the said jaws 6, 7 are moved inward to close upon a fastener 36, as, noting especially FIG. 2, floating cam surface 18 drivingly mates with jaw-cam 23*a* and floating cam surface 17 drivingly mates with jaw-cam 23*b*. A simultaneous, inward thrusting force is applied to the jaws since the said floating cam surfaces comprise wedge angled-surfaces inward that, when driven longitudinally downward, accomplish a strong, smooth, inward-thrusting contact between above said cam surfaces.

Figure 2B:
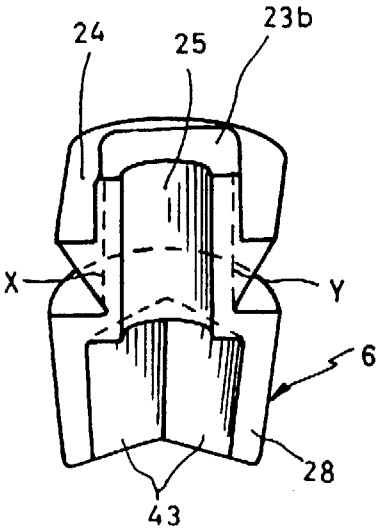
FIG. 2*b* is an inside angular perspective view of a single, complete jaw comprising dovetail rails.
Figure 2:
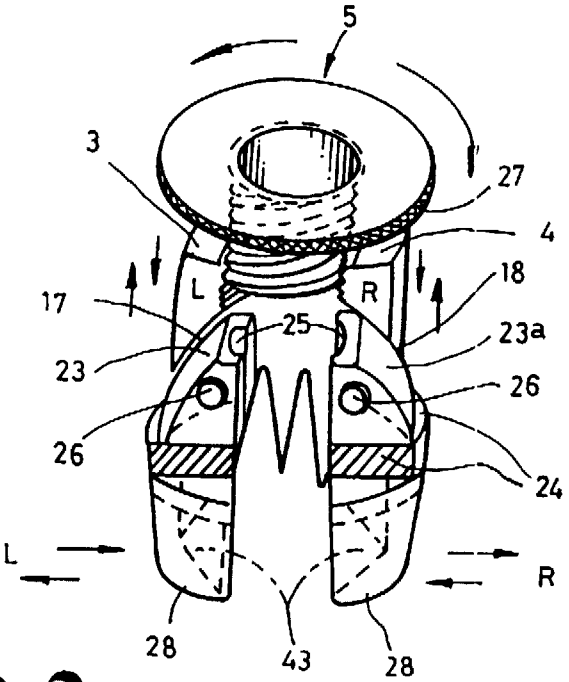
FIG. 2 is also an exploded assembly perspective view showing a side, left and right view of the jaws. This view excludes the ratchet gear to depict a clearer view of the various narrowed movements each part makes.
Figure 2A:
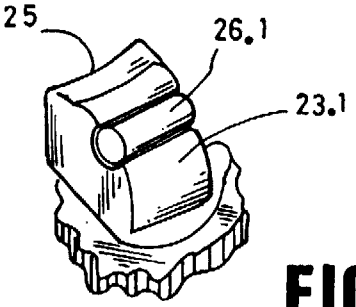
FIG. 2*a* is a perspective cutaway view of one of the jaw's integral cam portion comprising a rolling-pin, low-friction cam contact means.

In FIG. 2, note optional stabilizing pins 26, which either may be rotatably nested or press-fit into said jaw-cams 23*a*, 23*b*, respectively, which said pins may slide into a groove) not shown) that may be located in the wall of said rectangular bore 8. (It should be noted that this elongated said rectangular bore 8, through depicted as rectangular in shape could be of many shapes, one alternate shape being elongate-elliptical, that is, with the center portion having a curvature to it.) The said pins 23*a*, 23*b* would help to further sustain said jaw-spreading loads that tend to force the jaws apart under high wrenching-torquing applications. In FIG. 2*a* the pin is modified to act as a friction inhibiting roller 26.1, rotatably nested into modified, slotted-jaw cam 23.1.

In FIG. 5 note standard ratchet wrench 34, with pawl actuator 41 and handle 33, comprising the subject invention's adjustable-jawed gear 2 and further note said TSD 5, wherein through-hole 19 may accommodate a threaded rod 37. In FIGS. 2 and 2*a* an elliptical indenture 25 travels along the inside of the said jaws interior portion. This indenture 25 serves to allow through-access to smaller threaded rods as the jaws close upon smaller fasteners and their interior surfaces close necessarily flush together. As well, said annular flange 14 includes a knurled surface 9 that acts as a "speeder" when turning a fastener in or out by finger rotation and, of course, a standard wrench handle hinge 35 may be included in the neck portion 44 of said wrench 34.

FIG. 6 is simply a pneumatic ratchet wrench 38, comprising pawl-actuator 40, power actuator handle 42 and air-source connection port 39. Note modified TSD 5.1 with additional adjusting nubs 45 by which a wrench user may adjust the said jaw ends 28 together with one hand operation, as with the thumb or index finger.

Since the said AJG 2 has said jaws 6,7 which are positive-driven in only the closing direction, it is imperative that means are provided to consistently bias the jaws in an open position/direction. In FIG. 4, four sets of possible springs means are illustrated that would provide sufficient compressive spring force for this application. FIG. 4(*a*) comprises standard coil 29 compression springs. A double-tapering coil spring 29.1 is shown also in this figure, which would have less "buckling" effect than the standard coil springs 29 shown when compressed in the present application. FIG. 4(*b*) shows torsional 30 compression springs, such as used in the common safety pin. FIG. 4(*c*) depicts a hair pin 31 compression spring set and FIG. 4(*d*) illustrates a leaf 32 or ribbon-type compression spring pair. All these above spring pairs may function separately or be connected together to function similarly and may be located, noting FIG. 2*b* particularly, at or near pressure point X, and Y, respectively. Also, other compression points on the insides of the said jaws 6, 7 could be used as effectively as those of said points X, Y.

Also, there are other ratcheting-type mechanisms that do not necessarily use ratchet gear "teeth" as depicted in the drawings that may, however be seen by one skilled in the art to easily incorporate the above structure into what is otherwise a standard ratchet wrench, this not departing from the spirit and scope of the invention.

It is to be understood that the form of the invention herewith shown nd described above is to be taken as preferred embodiments. Various changes may be made in the shape, size and arrangement of parts, for example: other equivalent elements may be substituted for those illustrated and described herein, parts and elements may be reversed and certain features of the invention may be utilized independently of the use of other features, all without departing from the spirit or scope of the invention, as defined in the subjoining claims.

I claim:

1. An adjustable jawed ratchet gear means for use in standard ratchet wrenches comprising:

a ratchet gear body comprising an annular flange at one end; said flange including receiving rail portions, said ratchet gear body further comprising a bore;

at least two opposing jaws with which to grip a fastener on at least two sides; said jaws being rigidly, torsionally and slidably supported upon said receiving rail portions by wing-like rails, integrally located on said jaws; each said jaw further comprising at least one protruding cam portion integral to itself, whereupon jaw-closing drive force may be effected by means of;

a floating cam means comprising a threaded end portion at one end and a cam surface at the opposite end; said floating cam means being torsionally nested in said gear body bore for longitudinal reciprocation along an axis of said ratchet gear body; said cam surface of said floating cam means urging upon said protruding cam portion of both said jaws as said floating cam means longitudinal reciprocation is effected by means of;

a threaded-stemmed-disc means rotatably affixed within the central portion of the said bore; said threaded-stemmed disc's threaded stem portion mutually contacting said threaded end portion of said cam surface;

biasing means to continually urge said opposing jaws in an open position.

2. The adjustable jawed ratchet gear means as recited in claim 1 wherein:

said threaded-stemmed-disc means further comprises a hollow bore.

3. The adjustable jawed ratchet gear means as recited in claim 1 wherein:

said ratchet gear body bore is further defined as an elongated bore, substantially rectangular in structure.

4. The adjustable jawed ratchet gear means as recited in claim 1 wherein:

said annular flange has a knurled exterior and further comprises said receiving rail portions that are centrally, internally positioned with reference to a central axis of the said adjustable jawed gear.

5. The adjustable jawed ratchet gear means as recited in claim 4 wherein:

said receiving rail portions are dovetail shape in structure.

6. The adjustable jawed ratchet gear means as recited in claim 1 wherein:

said protruding cam portions are curved in structure and comprise a stabilizing pin nested therein; and wherein the said floating cam means cam portion is wedge-like in shape.

7. The adjustable jawed ratchet gear means as recited in claim 2 wherein:

said threaded-stemmed disc further comprises a knurled circumference for jaw adjusting actuation.

8. The adjustable jawed ratchet gear means as recited in claim 1 wherein:

the adjustable jawed gear is affixed within the wrench head bore of a standard ratchet wrench.

9. The adjustable jawed ratchet gear means as recited in claim 1 wherein:

the adjustable jawed gear is affixed with the wrench head bore of a standard, pneumatically operated ratchet wrench.

10. The adjustable jawed ratchet gear means as recited in claims 1 wherein:

the biasing means that continually urges said jaws in an open position is a standard coil spring means.

11. The adjustable jawed ratchet gear means as recited in claim 10 wherein:

the standard coil spring means is a double-tapered standard coil spring means.

12. The adjustable jawed ratchet gear means as recited in claim 1 wherein:

the biasing means is a leaf spring means.

13. The adjustable jawed ratchet gear means as recited in claim 1 wherein:

the biasing means is a hairpin type spring means.

14. The adjustable jawed ratchet gear means as recited in claim 1 wherein:

the biasing means is a torsional spring means.

15. The adjustable jawed ratchet gear means as recited in claim 1 wherein:

the threaded-stemmed disc further comprises an outer shoulder having a snap-ring groove receiving a snap-ring; said snap-ring rotatably joining said threaded-stemmed disc to an inner shoulder located upon an inside top portion of said adjustable jawed gear.

16. The adjustable jawed ratchet gear means as recited in claim 1 wherein:

said opposing jaws further comprise 120 degree angled fastener-gripping faces with which to grip a hexagonal fastener on at least 4 sides.

17. The adjustable jawed ratchet gear means as recited in claim 1 wherein:

said floating cam means comprises a single, unitized threaded cam means that further comprises a single, threaded through-bore at one end and at least one wedge-like cam-contacting surface at the opposite end.

* * * * *